United States Patent [19]

Brunt et al.

[11] Patent Number: 4,614,439

[45] Date of Patent: Sep. 30, 1986

[54] MIXER FOR MIXING FIBRES INTO A SLURRY

[75] Inventors: William H. Brunt, Tyldesley; Christopher J. Wilson, Chorley, both of England

[73] Assignee: Pilkington Brothers P.L.C., St. Helens, England

[21] Appl. No.: 751,398

[22] Filed: Jul. 3, 1985

[30] Foreign Application Priority Data

Jul. 6, 1984 [GB] United Kingdom ..... 8417352

[51] Int. Cl.[4] ..... B01F 7/16

[52] U.S. Cl. ..... 366/154; 366/307; 366/329

[58] Field of Search ..... 366/154, 295, 307, 329

[56] References Cited

U.S. PATENT DOCUMENTS

| | | | |
|---|---|---|---|
| 2,258 | 9/1861 | Mudge | 366/307 |
| 2,235,604 | 3/1941 | Brumagim | 366/329 |
| 2,964,301 | 12/1960 | Bosse | 366/329 |
| 3,404,870 | 10/1968 | Multer | 366/307 |
| 3,488,038 | 1/1970 | Staaf | 366/307 X |
| 3,995,839 | 12/1976 | Zingg | 366/154 |
| 4,254,699 | 3/1981 | Skinner et al. | 366/307 X |

FOREIGN PATENT DOCUMENTS

| | | | |
|---|---|---|---|
| 515640 | 11/1920 | France | 366/329 |

*Primary Examiner*—Philip R. Coe

*Attorney, Agent, or Firm*—Sughrue, Mion, Zinn, Macpeak and Seas

[57] ABSTRACT

A mixer for mixing glass fibres into a thick aqueous cement slurry comprises means for feeding glass fibres on to the surface of a batch of the slurry in an upright cylindrical chamber, an agitator mounted on a coaxial vertical shaft and carrying at its lower end both a plurality of short impeller blades and a long horizontal member with tip blades of opposite sense to the impeller blades, so as to cause vertical as well as horizontal circulation of the slurry, and stationary baffles on the wall of the chamber angled to cause production of standing waves on the surface of the slurry.

6 Claims, 3 Drawing Figures

MIXER FOR MIXING FIBRES INTO A SLURRY

BACKGROUND OF THE INVENTION

1. Field of the Invention This invention relates to mixers for mixing fibres into a slurry and particularly for mixing glass fibres into a relatively thick aqueous cement slurry, e.g. for use in forming glass fibre reinforced cement products on an asbestos-cement making machine of the Magnani type or, when appropriately diluted, on a machine of the Hatschek or Bell type.

2. Description of the Prior Art In such machines, an aqueous cement slurry, containing for example from 8 to 50% solids, is deposited on a foraminous surface and de-watered to form a sheet. In the Hatschek and Bell machines, after de-watering, successive sheets are deposited on an accumulator drum to build up a product of the desired thickness. When glass fibres are used instead of asbestos in such machines, difficulty has been experienced in mixing the glass fibres uniformly into the slurry. If a conventional paddletype mixing apparatus is used, the glass fibres have a tendency to clump together and to become unevenly distributed in the slurry and hence in the final product, which can thus fail to show the expected strength due to lack of reinforcement in some areas. Furthermore, the glass fibres can suffer mechanical damage from the mixing apparatus, which adversely affects their reinforcing effect in the composite material.

SUMMARY OF THE INVENTION According to the present invention, a mixer for mixing fibres into a slurry comprises an upright cylindrical chamber, means for supplying a batch of slurry into the chamber and means for feeding glass fibres on to the surface of the batch of slurry in the chamber, wherein an agitator is provided in the chamber in the form of a rotatable vertical shaft coincident with the axis of the chamber and carrying adjacent the lower end of the chamber both a plurality of impeller blades whose radial extent is substantially less than the radius of the chamber and at least one horizontal member with tip blades adjacent the cylindrical wall of the chamber, the impeller blades and the tip blades being angled in opposite senses to produce a vertical circulation as well as a rotational movement of the slurry. in the chamber, and stationary baffles are secured to the wall of the chamber and angled so that, in conjunction with the vertical and rotational movements of the slurry, they cause the production of standing waves on the surface of the slurry to assist in folding into the slurry glass fibres falling on to its surface.

The folding movement by which the glass fibres are incorporated into the slurry, in combination with the vertical and rotational movement of the slurry has been found to produce a rapid and uniform distribution of the glass fibres in the slurry, while the relatively short time of mixing minimises mechanical damage to the fibres.

Preferably the chamber has a conical bottom outlet for removing the batch of slurry after the glass fibres have been mixed into it.

In a preferred arrangement, the impeller blades are angled to cause downward movement of the slurry adjacent the axis of the chamber while the tip blades are angled to cause upward movement of the slurry adjacent to the chamber wall.

Preferably each stationary baffle has a curved front wall extending obliquely from the chamber wall to deflect the rotational movement of the slurry smoothly towards the middle of the chamber, and preferably also has a curved rear wall which fairs the baffle smoothly back into the chamber wall.

The means for feeding glass fibres on to the surface of the slurry may comprise a vibratory feeder disposed with its outlet above the chamber but offset from its axis.

DETAILED DESCRIPTION OF THE INVENTION

Figure 1:
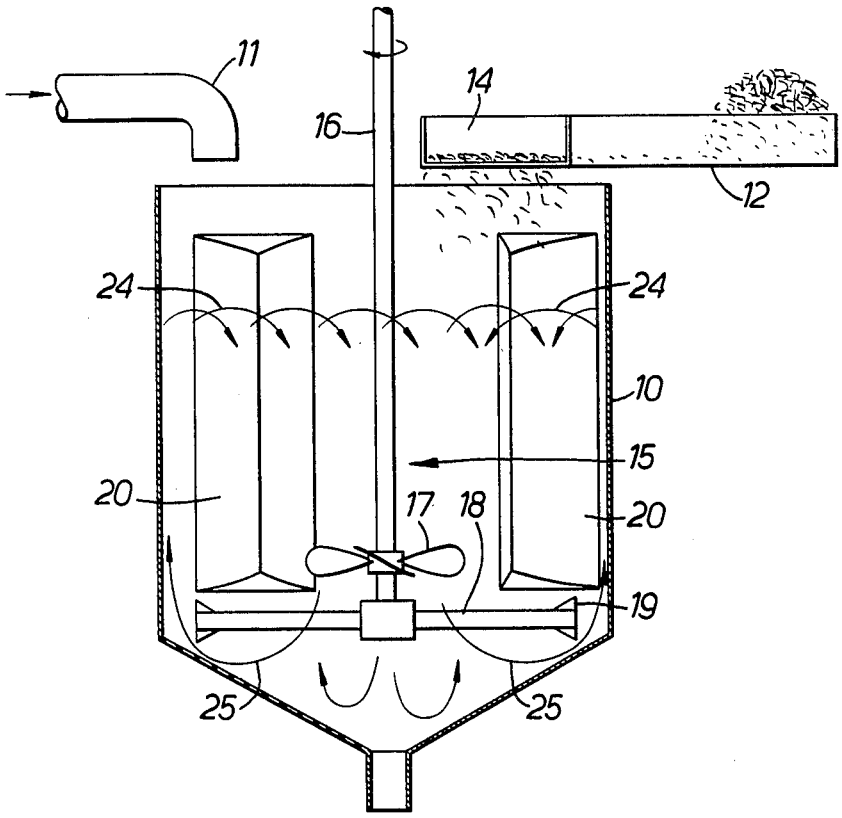
FIG. 1 is a cross-section of a mixer for mixing glass fibres into an aqueous cement slurry.
Figure 2:
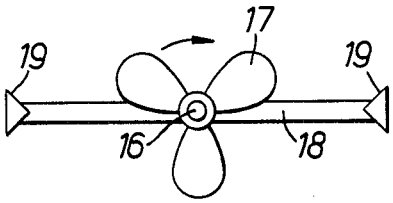
FIG. 2 is a fragmentary plan view showing the arrangement of the impeller blades and tip blades of the agitator.
Figure 3:
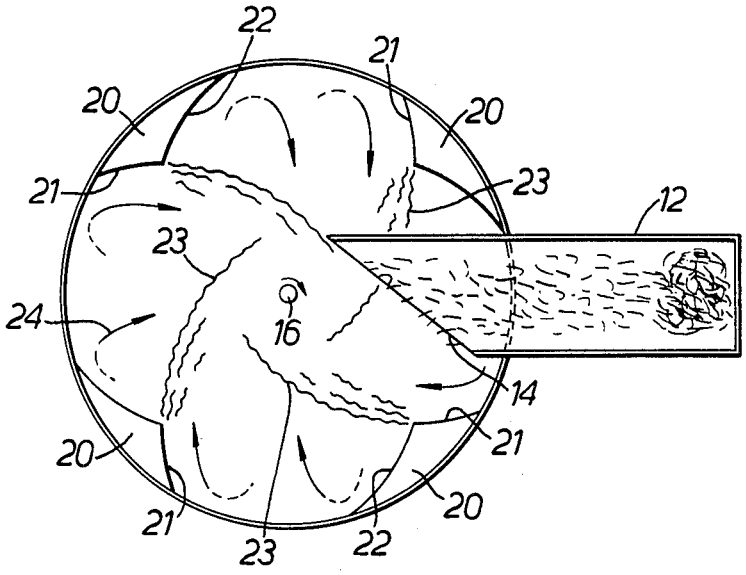
FIG. 3 is a plan view illustrating the fibre feed and the pattern of the slurry circulation as shown from above.

The mixer or blender illustrated in the accompanying drawings comprises an upright cylindrical chamber 10 into which batches of aqueous cement slurry can be fed through a pipe 11 and corresponding amounts of glass fibre can be fed through a vibratory feeder 12 whose outlet 14 is disposed above the chamber 10 but offset from its axis. An agitator 15 is provided in the chamber 10 in the form of a rotatable vertical shaft 16 disposed on the axis of the chamber 10 and carrying adjacent the lower end of the chamber a plurality (3 as shown) of impeller blades 17 whose radius is less than $\frac{1}{3}$ of the radius of the chamber 10 and a horizontal bar 18 carrying tip blades 19 adjacent the cylindrical wall of the chamber 10. The impeller blades 17 and the tip blades 19 are angled in opposite senses so as to produce a vertical circulation of slurry in the chamber 10 by drawing the slurry downwards adjacent the axis of the chamber and forcing it upwards adjacent the chamber wall. The rotary movement of the agitator 15 also induces a rotational movement of the slurry in the chamber 10.

A plurality (4 as shown) of stationary baffles 20 are disposed on the interior surface of the wall of the chamber 10. Each baffle 20 has a curved front wall 21 (considered in relation to the direction of the rotational movement of the slurry) extending obliquely from the chamber wall to deflect the rotational movement of the slurry smoothly towards the middle of the chamber, and a curved rear wall 22 which fairs the baffle smoothly back into the chamber wall and avoids accumulation of slurry behind the baffle.

The baffles 21, in combination with the vertical and rotational movement of the slurry caused by the agitator 15, give rise to standing waves in the surface of the slurry in the chamber, as indicated at 23.

When the glass fibres are fed from the feeder 12 onto the surface of the slurry in the chamber 10, they are thus folded smoothly into the slurry and uniformly distributed in it. The vertical and rotational movement indicated by the arrows 24, 25 and produced by rotation of the agitator 15 rapidly distributes the fibres uniformly through the batch of slurry so that only a short time of mixing is necessary and mechanical damage to the fibres is substantially avoided.

We claim:

1. A mixer for mixing fibres into a slurry, comprising an upright cylindrical chamber, means for supplying a batch of slurry into the chamber and means for feeding glass fibres on to the surface of the batch of slurry in the chamber, wherein an agitator is provided in the chamber in the form of a rotatable vertical shaft coincident with the axis of the chamber and carrying adjacent the lower end of the chamber both a plurality of impeller blades whose radial extent is substantially less than the radius of the chamber and at least one horizontal member with tip blades adjacent the cylindrical wall of the chamber, the impeller blades and the tip blades being angled in opposite senses to produce a vertical circulation as well as a rotational movement of the slurry in the chamber, and stationary baffles are secured to the wall of the chamber and angled so that, in conjunction with the vertical and rotational movements of the slurry, they cause the production of standing waves on the surface of the slurry to assist in folding into the slurry glass fibres falling on to its surface.

2. A mixer according to claim 1 wherein the chamber has a conical bottom outlet for removing the batch of slurry after the glass fibres have been mixed into it.

3. A mixer according to claim 1 wherein the impeller blades are angled to cause downward movement of the slurry adjacent the axis of the chamber while the tip blades are angled to cause upward movement of the slurry adjacent to the chamber wall.

4. A mixer according to claim 1 wherein each stationary baffle has a curved front wall extending obliquely from the chamber wall to deflect the rotational movement of the slurry smoothly towards the middle of the chamber.

5. A mixer according to claim 4 wherein each stationary baffle has a curved rear wall which fairs the baffle smoothly back into the chamber wall.

6. A mixer according to claim 1 wherein the means for feeding glass fibres on to the surface of the slurry comprises a vibratory feeder disposed with its outlet above the chamber but offset from its axis.

* * * * *